US009925800B2

(12) United States Patent
Cork et al.

(10) Patent No.: US 9,925,800 B2
(45) Date of Patent: Mar. 27, 2018

(54) ADHESIVE FILM PRINTING APPARATUS

(71) Applicant: A2N Incorporated, Somerset, WI (US)

(72) Inventors: Allen Cork, New Richmond, WI (US); Andy Brown, Baldwin, WI (US)

( * ) Notice: Subject to any disclaimer, the term of this patent is extended or adjusted under 35 U.S.C. 154(b) by 0 days.

(21) Appl. No.: 15/058,840

(22) Filed: Mar. 2, 2016

(65) Prior Publication Data

US 2017/0120624 A1 May 4, 2017

Related U.S. Application Data

(60) Provisional application No. 62/249,624, filed on Nov. 2, 2015.

(51) Int. Cl.
*B41J 3/407* (2006.01)

(52) U.S. Cl.
CPC ..... *B41J 3/4075* (2013.01)

(58) Field of Classification Search
CPC ..... B41J 3/4075
See application file for complete search history.

(56) References Cited

U.S. PATENT DOCUMENTS

| | | | | |
|---|---|---|---|---|
| 6,602,006 | B2 | 8/2003 | Saksa | |
| 6,648,533 | B2 | 11/2003 | Lo et al. | |
| 6,848,779 | B2 | 2/2005 | Lo et al. | |
| 2002/0057300 | A1* | 5/2002 | Baker | B65B 51/067 347/2 |
| 2003/0099495 | A1* | 5/2003 | Look | B41M 5/41 400/120.01 |
| 2003/0132980 | A1* | 7/2003 | Yamazaki | B41J 2/17509 347/19 |
| 2003/0192639 | A1* | 10/2003 | Mitchell | B41J 3/4075 156/250 |
| 2005/0019081 | A1* | 1/2005 | Baker | B41J 3/4075 400/615.2 |
| 2011/0150554 | A1* | 6/2011 | Shpigel | B41F 17/13 400/613 |

* cited by examiner

*Primary Examiner* — Alessandro Amari
*Assistant Examiner* — Roger W Pisha, II
(74) *Attorney, Agent, or Firm* — Winthrop & Weinstine, P.A.

(57) ABSTRACT

A printing apparatus may include a dispensing device and a print device. The dispensing device may be configured for dispensing a film, wherein the film has an adhesive side. The print device may be arranged about the dispensing device in a position and orientation allowing the print device to impart information onto the adhesive side of the film.

20 Claims, 15 Drawing Sheets

130
132
134
136
138
140
142
144
146
148
150
152
154
156
158
160
162
164
166
168
170
172
174
176
178
180
182
184
186
188
190
192
194
196
198
200
202
204
206
208

100

110
172
174
176
178
180
182
184
186

ADHESIVE FILM PRINTING APPARATUS

CROSS REFERENCE TO RELATED APPLICATION

This application claims the benefit of U.S. provisional patent application No. 62/249,624, filed on Nov. 2, 2015, entitled "Adhesive Tape Printing Apparatus and Method," the disclosure of which is hereby incorporated by reference herein in its entirety.

FIELD OF THE INVENTION

The present application relates to systems and methods for packaging. Particularly, the present disclosure relates to generating packaging labels, films, tape, and/or other adhesives that are tamper resistant and/or tamper proof and difficult to duplicate. More particularly, the present disclosure relates to systems and methods for providing printing or marking on packing tape and/or labels prior to applying the tape or labels to the package. Still more particularly, the systems and method relate to providing printing or marking on the adhesive side of the tape or labels so as to allow for customization and to cause such marking or printing to be automatically protected upon application of the tape or label to a package.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Films, tapes, labels, and other adhesives are commonly used in the packaging and transport of boxes and other packages. Company logos, shipping information, or other information may be printed onto the film. Typically, the printing of this information occurs on the non-adhesive side of the film. However, because the non-adhesive side of the film is often left exposed, the printed information can be rubbed off, altered, tampered with, or otherwise changed or removed. Moreover, the printed film often comes in reels that must be changed out on taping machines. Thus, if a user desires to have different information, e.g., a different company logo, applied, he must change out the reel on the taping machine, which can be a time consuming process.

BRIEF SUMMARY OF THE INVENTION

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

In one or more embodiments, an adhesive film printing machine may print or impart information onto the adhesive side of a tape, label, or other adhesive film. The printed or imparted information may include, but is not limited to, company logos, shipping information, shipping recipient or sender information, package contents, serial numbers, bar codes, or any other desirable information. The printed film may be applied to a package, box, or item such that the printed information is substantially tamper resistant or tamper proof. The adhesive film printing machine may also print individualized and/or unique information for one or more boxes, packages, or items prior to the film being applied.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

Figure 1:
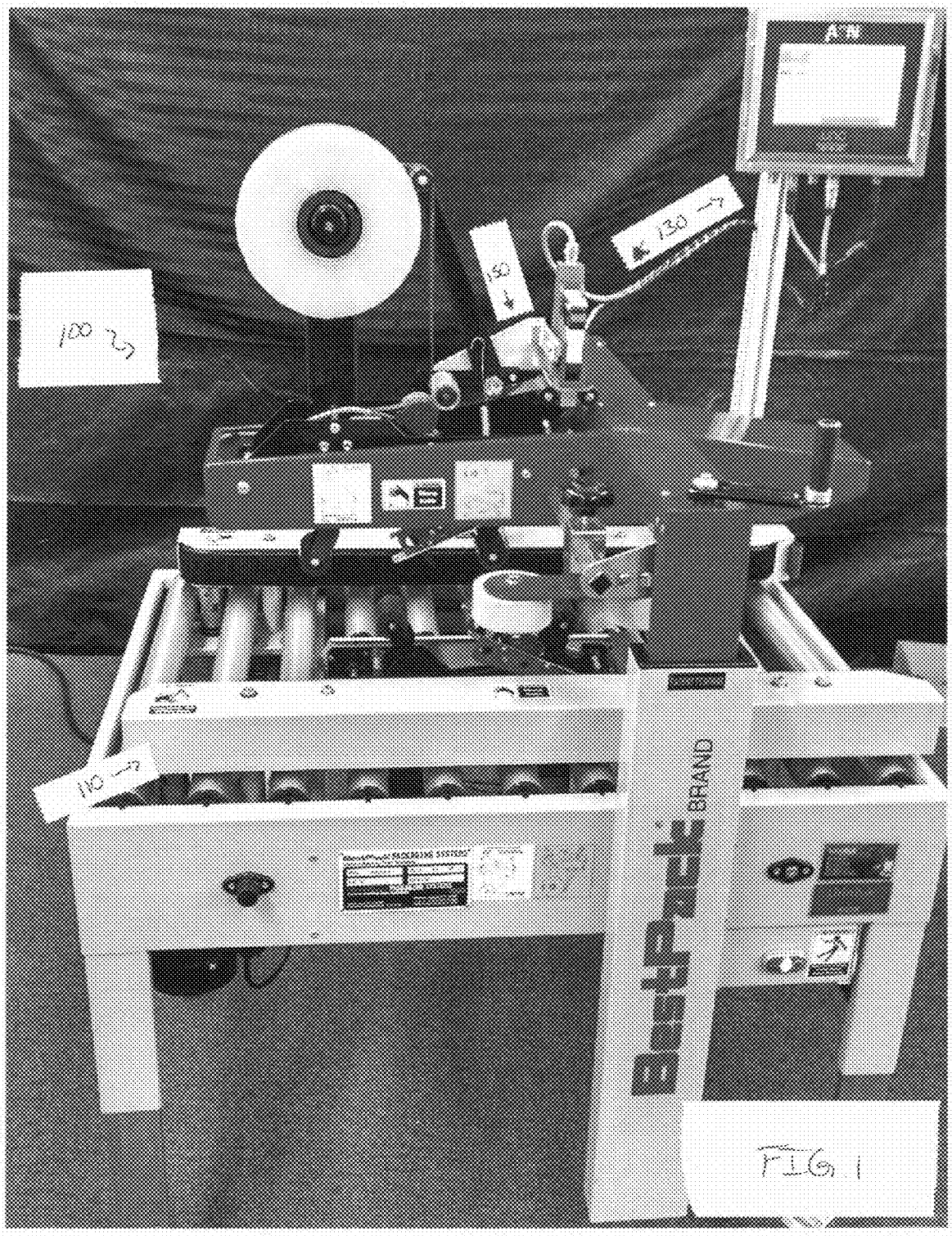
FIG. 1 shows a side view of an adhesive film printing machine, according to an embodiment of the present disclosure.

The present disclosure, in some embodiments, relates to a taping machine, device, or apparatus having mounted thereon, a printer or print head. The printer or print head may be mounted so as to provide printed information on the adhesive side of the tape. When clear, transparent, or semi-transparent tape, film, or other adhesive is applied to a package, device, or other object, the information printed on the adhesive side may be protected from smudging, tampering, altering, or otherwise modifying and yet be viewable through the tape, film, or other adhesive. The device may provide variable or fixed messaging on the adhesive side of packaging tape during the dispensing process.

Referring to FIGS. 1-5, in various embodiments of the present disclosure, an adhesive film printing apparatus 100, may be comprised of a taping device 110, a printing device 130, and a mounting device 150. The taping device 110 may be configured to apply the tape, film, or other adhesive (herein "film") to a box, package, or other item. The printing device 130 may be configured to print information onto the adhesive side of the film. The mounting device 150 may be configured to mount one or more components of the printing device 130 onto the taping device 110.

In various embodiments, the taping device 110, may be a box taper or taping machine. In some embodiments, commercially available box tapers or taping machines may be used. For example, a packaging system, as seen in FIGS. 1-5, may be used. As may be appreciated, other makes and/or models of taping machines may be used. The taping device 110 may be comprised of various components including, but not limited to, a frame 111, a dispensing system 112, and a package platform 113. The frame 111 may be configured to support and/or elevate the dispensing system 112 and package platform 113. The dispensing system 112 may be configured to hold, dispense, route, and/or apply a supply of film 114 onto a package, box, or other item. The package platform 113 may be a surface configured to support a box, package, or other item such that the dispensing system 112 may apply the film 114.

In some embodiments, the frame 111 may be comprised of one or more materials, including but not limited to, aluminum, steel, plastic, or any other suitable material.

Figure 4:
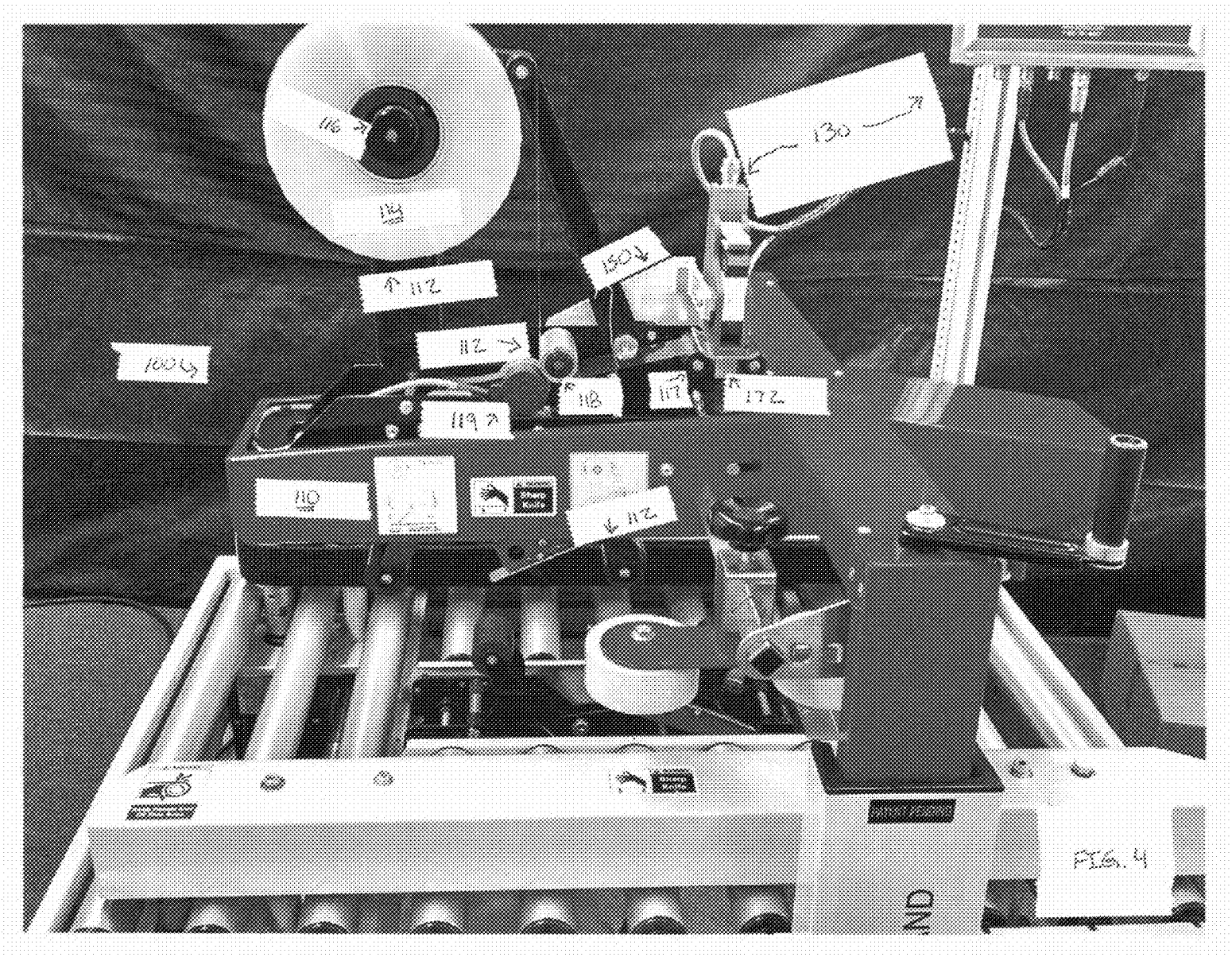
FIG. 4 shows an adhesive film printing machine, according to an embodiment of the present disclosure.
Figure 5:
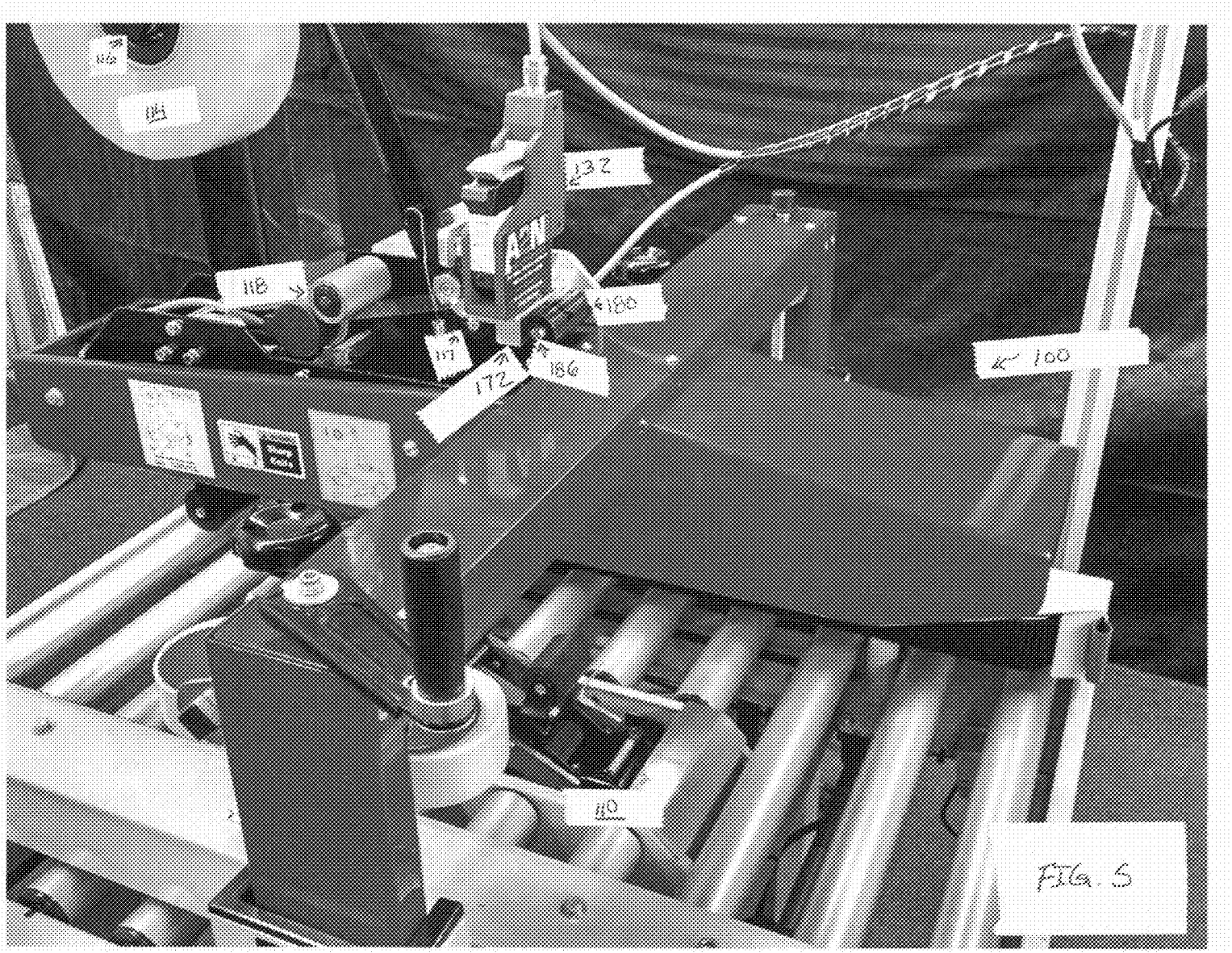
FIG. 5 shows a top view of an adhesive film printing machine, according to an embodiment of the present disclosure.
Figure 14:
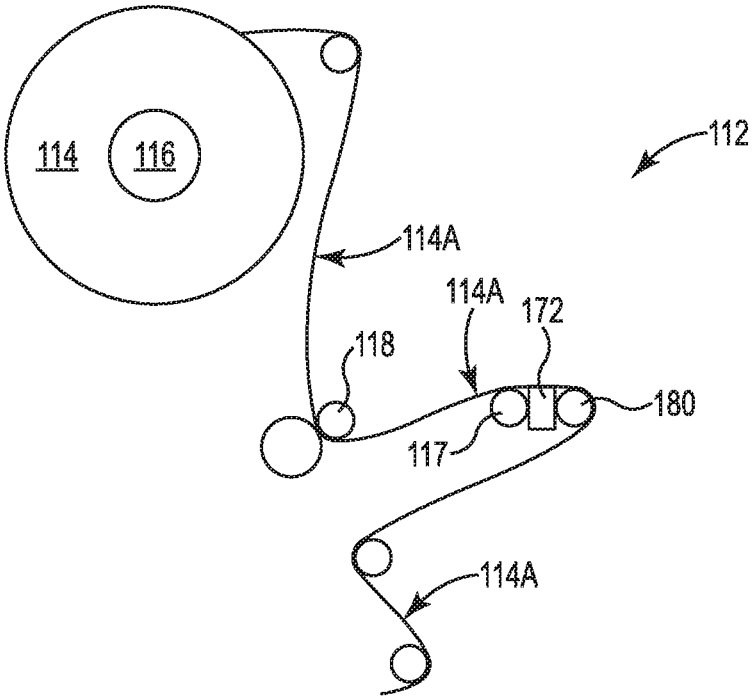
FIG. 14 is a schematic of a dispensing system, according to an embodiment of the present disclosure.

Referring to FIGS. 4 and 5 and 14, the dispensing system 112 may be comprised of one or more rollers 116, 117, 118. Rollers 116, 117, and 118 may be configured to hold, dispense, route, and apply the film 114. In at least one embodiment, film supply roller 116 may be configured to hold the initial supply of film 114. In various embodiments, the supply of film 114, may be a reel of tape, label, or other adhesive material. In some embodiments, the film 114 may be ½-5 inches wide. In other embodiments, the film 114 may be less than ½ an inch. In still other embodiments, the film 114 may be more than 5 inches wide. In some embodiments, the film 114 may be clear, transparent, and/or semi-transparent. Any commercially available tape, label, or other adhesive material may be used.

In various embodiments, rollers 117, 118 of the dispensing system 112 may be configured to dispense, route, and/or apply the film 114. In various embodiments, zero, one, or more of the rollers may be smooth such as, for example, roller 117. In some embodiments, zero, one, or more of the rollers may be knurled such as, for example, roller 118. In other embodiments, any suitable roller and/or combination of different rollers may be used. In various embodiments, the one or more rollers 117, 118 may be configured to contact the non-adhesive side 114A of the film 114, thereby directing the flow of the film 114 as it passes through the taping device 110. In various embodiments, one or more components of the mounting device 150, as seen in FIG. 4, may also hold and/or direct the flow of the film 114.

Figure 2:
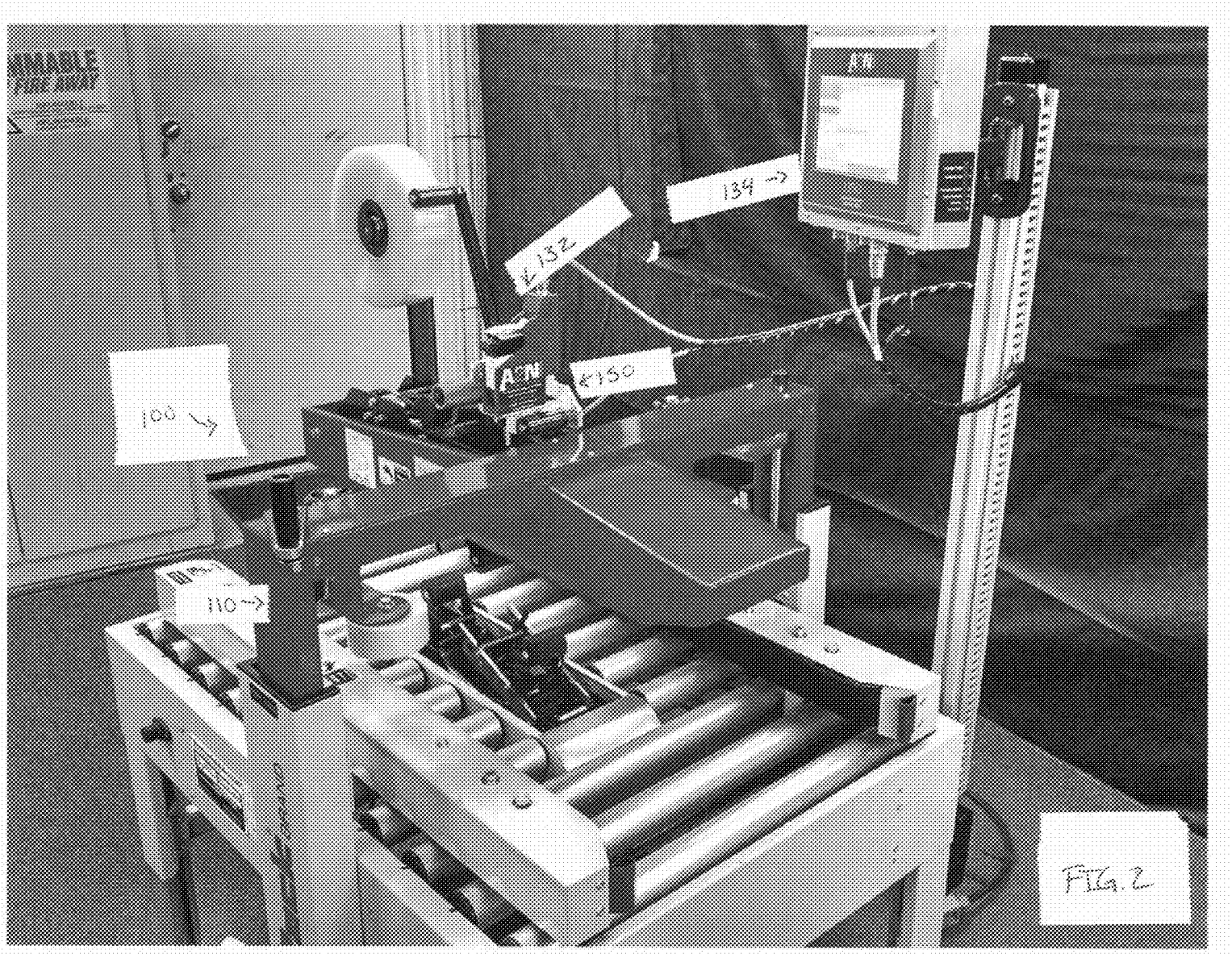
FIG. 2 shows a side view of an adhesive film printing machine, according to an embodiment of the present disclosure.
Figure 3:
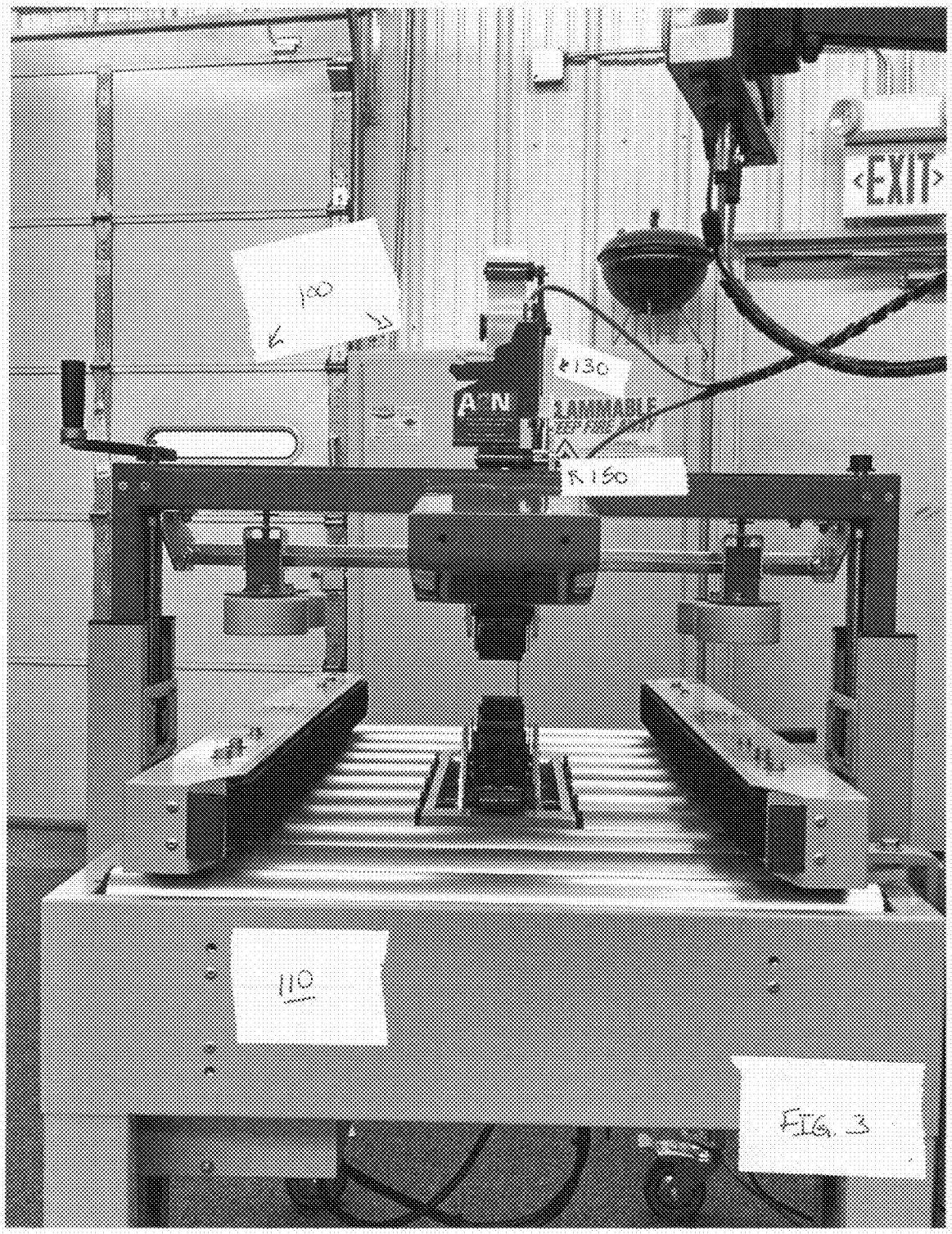
FIG. 3 shows a side view of an adhesive film printing machine, according to an embodiment of the present disclosure.

Referring to FIGS. 1, 2, and 4, in various embodiments, the printing device 130 may be configured to print information on an adhesive side of the film 114. In some embodiments, the printing device 130 may be comprised of a printer 132 and a printing control system 134. The printer 132 may be configured to print information onto the adhesive side of the film 114. The printing control system 134 may be configured to receive information and/or user input. The printing control system 134 may also be configured to communicate with the printer 132, such that it may instruct what, and when, various information is printed.

In various embodiments, the printer 132 may be an ink jet printer, such as those provided by Hewlett Packard, Epson, and/or Cannon. Any suitable printer may be used. In various embodiments, the printer 132 may print information on all or part of the film 114. In some embodiments, multiple configurations may be installed. For example, one or more printers 132 may be used. In some embodiments, a printer 132 may be configured to print onto a film 114 that is substantially applied to a top side of a package, box, or item. In other embodiments, a printer 132 may, additionally or alternatively, be configured to print onto a film 114 that is substantially applied to a bottom side of a package, box, or item. In still other embodiments, one or more printers 132 may, additionally or alternatively, be configured to print onto a film 114 that is substantially applied to one or more sides of the box, package, or item. As may be appreciated, in some embodiments, the information printed on the adhesive side may be printed as a mirror image or a lateral inverse image in order to be able to read or see the image, as intended, once the film 114 is applied to the box, package, or item. In other embodiments, any print orientation may be used.

In various embodiments, the printing control system 134 may be configured to provide the printing information that the printer 132 prints onto the film 114. In some embodiments, the printing control system 134 may mechanically connect, such as being hardwired, to the printer 132 and/or taping device 110. In still other embodiments, the printing control system 134 may, additionally or alternatively, connect to the printer via a wireless connection, and thus may be located at some remote location.

The printing control system 134 may be configured to receive information from one or more sources. In some embodiments, a user interface may be connected to the adhesive film printing apparatus 100. In other embodiments, a user interface may, additionally or alternatively, be located at a remote location. In still other embodiments, the printing control system 134 may, additionally or alternatively, be configured to receive information from one or more computers, sensors, or inputs at a location on an assembly line upstream or downstream from the adhesive film printing apparatus 100. In some embodiments, the received information from one or more sources may indicate what type of box, package, or item is approaching the adhesive film printing apparatus 100. In various embodiments, the received information may include the contents of the box, package, or item, the size of the box, or any unique box configurations. In various embodiments, the received information may, additionally or alternatively, include, but is not limited to, information about the manufacturer of the contents; information about the distributor of the contents; information about the intended recipient of the box, package, or item; information about the person or company sending the box, package, or item; lot number(s); batch number(s); any other identifying information for purposes of source control; and/or any other suitable information.

The printing control system 134 may use the received information to activate one or more printing programs. In various embodiments, a printing program may be configured to print individualized information for a specific box, package, or item. In various embodiments, the information may contain fixed or variable words, letters, numbers, bar codes, serial numbers, or any other information. For example, the individualized information may include, but is not limited to, information describing or identifying the contents of the box package or item, the sender, the intended recipient, the manufacturer, the distributor, mailing information, lot number(s), batch number(s), or any other desirable information. As the specific box, package, or item approaches the adhesive film printing apparatus 100, the printer 132 may print the individualized information onto the film 114, thereby preparing the film for application to the package, box, or item.

In some embodiments, printing may be initiated by the tape being dispensed. In various embodiments, the rate at which the printer 132 prints onto the film 114 may vary. In at least one embodiment, the dispensing rate of the film 114 may be monitored and communicated to the printer 132 such that the information imparted by the printer 132 may be applied at a rate consistent with the dispensing rate of the film 114. In some embodiments, the one or more rollers of the dispensing system 112 may be configured to detect and/or control the dispensing rate of the film 114. For example, the one or more rollers of the dispensing system 112 may include an encoder wheel 119, as seen in FIG. 4. The motion of the dispensing film 114 may be transferred to the rotary encoder 119 allowing such a rate to be ascertained. In other embodiments, the printer 132 or print control system 134 may, additionally or alternatively, include a sensor that is capable of detecting the dispensing rate of the film 114. Any suitable means or method to detect and/or control the dispensing rate and/or print rate may be used.

The printed film 114 may then continue through the dispensing system 112 and be applied to the specific box, package, or item. In at least one embodiment, a program with individualized information may exist for each box, package, or item that passes through the adhesive film printing apparatus 100. In other embodiments, a program may print information for one or more boxes, packages, or items. For example, a program may be configured to print the same information onto film 114 for an entire day, week, month, etc. In another example, a program may be configured to print similar information onto film 114 for application to a pre-determined number of boxes, e.g., 100 boxes. In still other embodiments, a program may be configured to alternate between two or more unique prints. For example, every other box, package, or item that passes through the adhesive film printing apparatus 100 may have different information printed onto the film 114 that is applied to it. As may be appreciated, every box; package, or item may have a film 114 applied to it that contains different and/or unique information. For example, individualized batch, tracking, and/or shipping information. Any suitable program(s) may be used.

Figure 6:
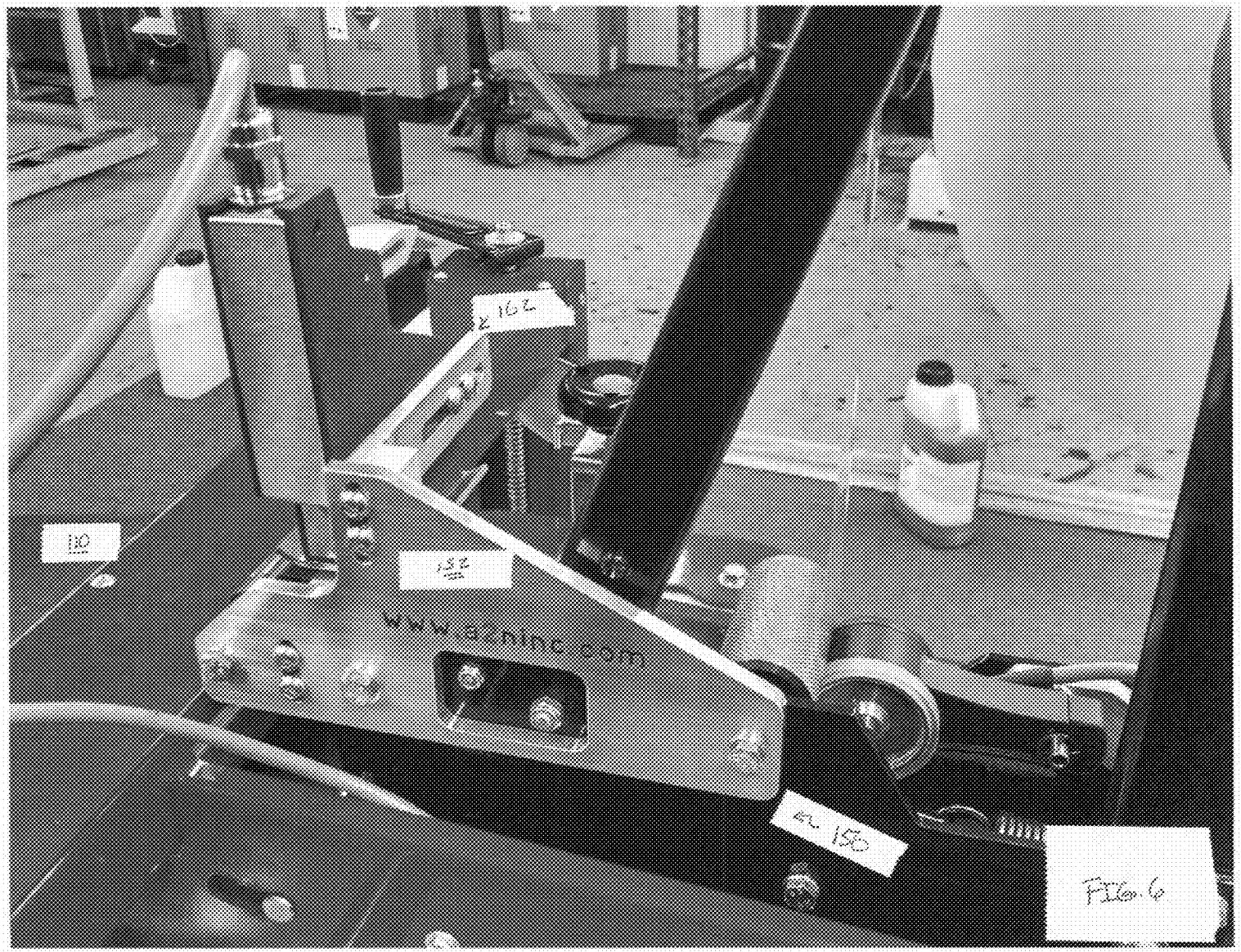
FIG. 6 shows a front view of a mounting device, according to an embodiment of the present disclosure.
Figure 7:
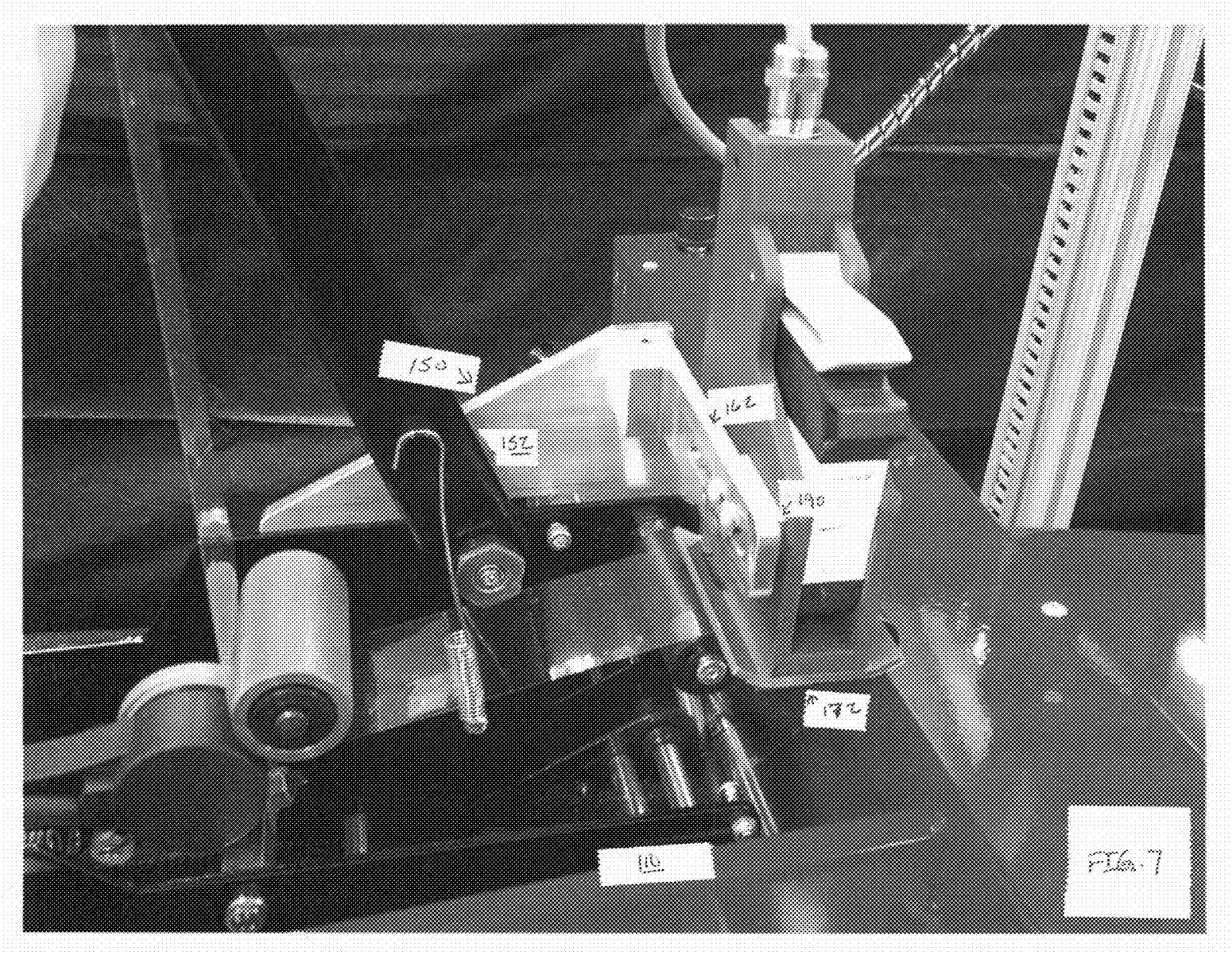
FIG. 7 shows a back view of a mounting device, according to an embodiment of the present disclosure.

Referring to FIGS. 6 and 7, a mounting device 150 may be used to mount and/or orient the printer 132 on the taping machine 110. In some embodiments, the mounting device 150 may be used to mount and/or orient the printer 132 in a position substantially aligned with the dispensing route, such that the printer 132 may print onto the film 114 as it is dispensed through dispensing system 112. The mounting device 150 may also be configured to provide a printing surface or table 174, as seen in FIG. 11. In various embodiments, and with reference to FIGS. 5-7, the mounting device 150 may include a main bracket 152, a cross mount bracket 162, a print table 172, a mounting roller 180, a roller shaft 186, and an adapter block 190. The main bracket 152 may be configured to connect the printer 132, the taping machine 110, and the one or more other components of the mounting device 150. The cross mount bracket 162 may be configured to connect the main bracket 152 to the printer 132. The print table 172 may be configured to provide a flat, or substantially flat, surface for the printer 132 to print onto the film 114. The mounting roller 180 may be configured to temporarily redirect or reroute the film 114 along the dispensing system 112, such that the film 114 may pass over the printing table 172. The roller shaft 186 may be configured to connect the mounting roller 180 to the main bracket 152. The adapter block 190 may be configured to assist the cross mount bracket 162 in connecting the printer 132 to the main bracket 152. In other embodiments, one or more components may alternatively be combined and/or omitted. In various embodiments, a mounting device 150 may be configured to mount the printing device 130 to the tape head of various manufacturers of tape dispensing machines.

Figure 8:
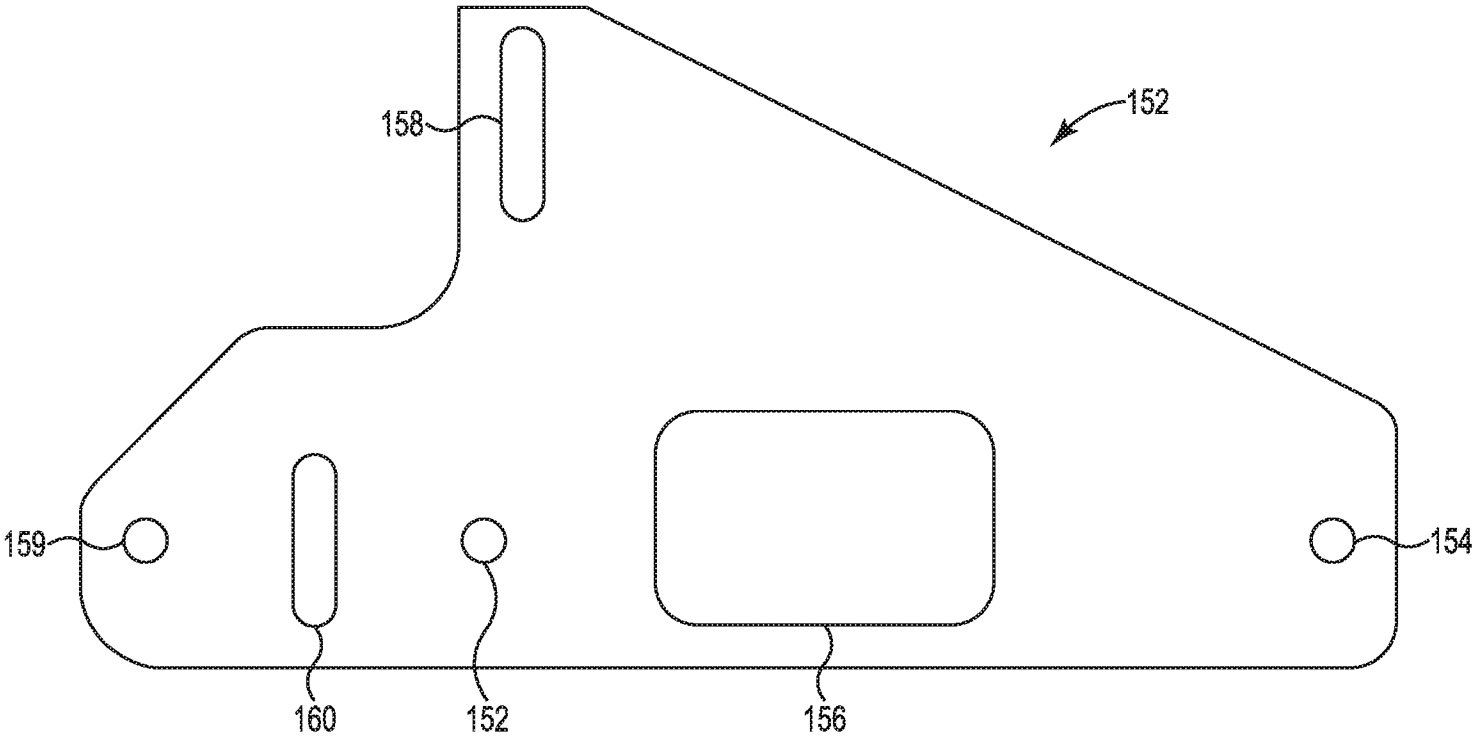
FIG. 8 is a perspective view sketch of a main bracket, according to an embodiment of the present disclosure.

Referring to FIGS. 6-8, the main bracket 152 may be configured to attach a print head or printer 132 to an existing and/or conventional taping device 110. The main bracket 152 may have one or more openings or eyes 154, 155, which may be configured to affix the main bracket 152 to the taping device 110. In one or more embodiments, the eyes 154 may be configured to align with existing taping device 110 hardware or parts. For example, the eyes 154 may be used to attach the main bracket 152 to the taping device 110 at the same or similar location as where knurled roller 118 and smooth roller 117 connect to the taping device 110. Any suitable means to secure the main bracket 152 to the taping device 110 using the one or more eyes 154 may be used, for example, a screw or other fastener may be used. In some embodiments, the main bracket 152 may also have one or more windows 156, which may be configured to provide access to existing taping device 110 components. In various embodiments, the main bracket 152 may also be configured with one or more apertures 158, 159, and 160. In at least one embodiment, a cross mount aperture 158, a roller shaft aperture 159, and a print table aperture 160 may be provided. In other embodiments, one or more aperture may, additionally or alternatively, be provided.

In various embodiments, the main bracket 152 may be steel, aluminum, and/or other metal. In at least one embodiment, the main bracket 152 may be comprised of a quarter inch thick aluminum. In other embodiments, any suitable metal having any suitable thickness may be used. In still other embodiments, a non-metal, such as a hard plastic may, additionally or alternatively, be used for some of, or the entire, main bracket 152. As may be appreciated, the main bracket 152 may, additionally or alternatively, be incorporated into one or more parts of the taping device 110. That is, the taping device 110 may be manufactured and/or retrofitted to incorporate various components of the main bracket 152.

Figure 9C:
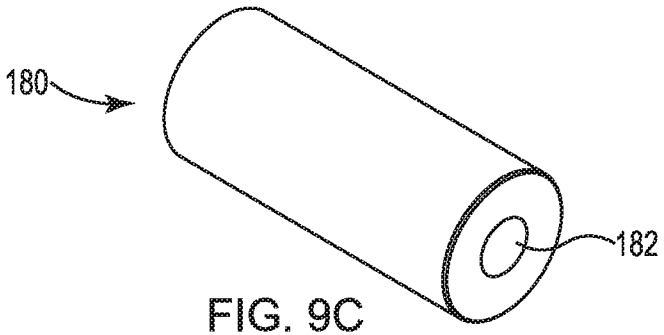
FIG. 9C is a perspective view sketch of a mounting roller, according to an embodiment of the present disclosure.
Figure 9B:
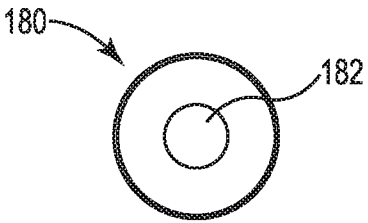
FIG. 9B is a perspective view sketch of a mounting roller, according to an embodiment of the present disclosure.
Figure 9A:
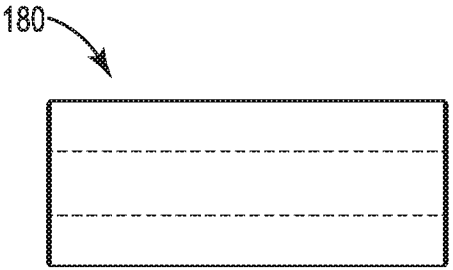
FIG. 9A is a perspective view sketch of a mounting roller, according to an embodiment of the present disclosure.

In various embodiments, and in reference to FIGS. 9A-C, the mounting roller 180 may be, generally, a rounded cylinder. In some embodiments, the mounting roller 180 may be 1-5 inches in long. In other embodiments, it may be shorter or longer than 1-5 inches. In some embodiments, the mounting roller 180 may be ½ an inch to 3 inches in diameter. In other embodiments, the mounting roller 180 may be less than ½ an inch or greater than 3 inches in diameter. In some embodiments, the mounting roller 180 may have an interior cavity 182, which may be configured to receive the roller shaft 186 (see FIG. 10). In some embodiments, the interior cavity 182 may, generally, be a rounded tube. In other embodiments, the interior cavity 182 may be any polygonal shape, i.e., a triangle, square, pentagon, hexagon, etc. In various embodiments, the general diameter of the interior cavity 182 may be less than the diameter of the mounting roller 180. For example, and as seen in FIGS. 9A-C, a mounting roller 180 may have a diameter of 0.98 inches and the interior cavity 182 may have a diameter of 0.386 inches. In some embodiments, the interior cavity 182 may extend through the entire length of the mounting roller 180. In other embodiments, the interior cavity 182 may extend less than the entire length of the mounting roller 180. In various embodiments, the length, size, and shape of the interior cavity 182 may, generally, be configured to receive the roller shaft 186. In various embodiments, the mounting roller 180 may be comprised of a black delrin material. In other embodiments, any suitable material may be used.

Figure 10C:
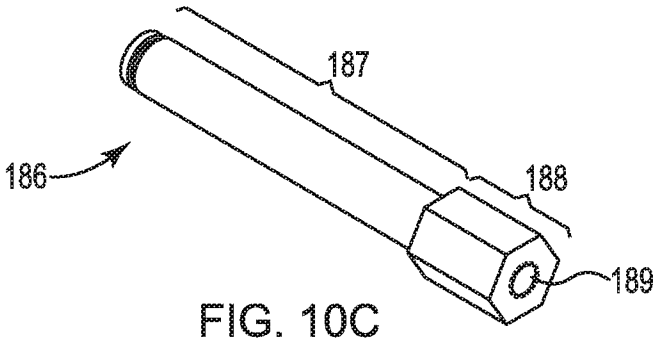
FIG. 10C is a perspective view of a sketch of a roller shaft, according to an embodiment of the present disclosure.
Figure 10B:
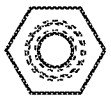
FIG. 10B is a perspective view of a sketch of a roller shaft, according to an embodiment of the present disclosure.
Figure 10A:
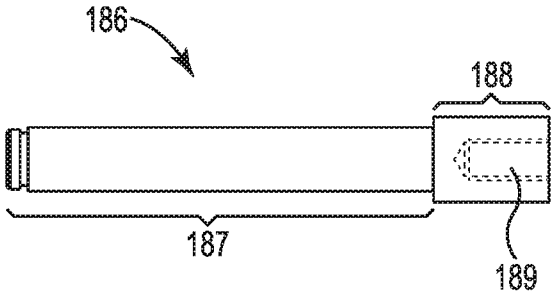
FIG. 10A is a perspective view of a sketch of a roller shaft, according to an embodiment of the present disclosure.

The roller shaft 186, as seen in FIGS. 10A-C, may be configured to connect the mounting roller 180 to the main bracket 152. In some embodiments, the roller shaft 186 may generally be a rounded cylinder. In other embodiments, the roller shaft 186 may, additionally or alternatively, be one or more polygonal shapes. In various embodiments, the roller shaft 186 may be comprised of a mounting roller insert 187 and a main bracket connection 188. In other embodiments, the mounting roller insert 187 and main bracket connection 188 may be the combined as one piece. The mounting roller insert 187 may, generally, be configured to insert into the interior cavity 182 of the mounting roller 180 and the main bracket connection 188 may be configured to secure the roller shaft 186 to the main bracket 152. In at least one embodiment, the end of the mounting roller insert 187 opposite of the main bracket connection 188 may have a means to secure the mounting roller 180 to the roller shaft 186. For example, in some embodiments, where the mounting roller insert 187 passes entirely through the mounting roller 180, the mounting roller insert 187 may be threaded, such that a bolt, or other fastening means, may be used to secure the mounting roller 180 onto the mounting roller insert 187. In other embodiments, where the mounting roller insert 187 does not extend through the end of the mounting roller 180, the mounting roller insert 187 and mounting roller 180 may be configured to snap together, for example, using corresponding grooves and protrusions. Any means to secure the mounting roller 180 onto the mounting roller insert 187 may be used. In some embodiments, the mounting roller 180 may be configured to rotate around a fixed mounting roller insert 187. In other embodiments, the mounting roller insert 187 may, additionally or alternatively, rotate.

The mounting roller insert 187 may be connected to the main bracket connection 188. In various embodiments, the main bracket connection 188 may have a cavity 189, which may be configured to receive a bolt or screw. In some embodiments, the cavity 189 may extend into the mounting roller insert 187. In at least one embodiment, the cavity 189 may be threaded. In some embodiments, the cavity 189 may pass through the entire length of the roller shaft 186. In other embodiments, the cavity 189 may extend less than the full length of the roller shaft 186. In still other embodiments, the cavity 189 may extend less than the full length of the main bracket connection 188. In some embodiments, the main bracket connection 188 may have the same size and shape as the mounting roller insert 187, thereby, generally, giving the roller shaft 186 a uniform look. In other embodiments, as seen in FIGS. 10A-C, the main bracket connection 188 may have a different size and/or shape than the mounting roller insert 187. In various embodiments, the main bracket connection 188 may be circular. In other embodiments, the main bracket connection 188 may, additionally or alternatively, be any polygonal shape. In at least one embodiment, the main bracket connection 188 may be hexagonal, such that a wrench may be used to fasten it.

In some embodiments, the roller shaft 186 may be composed of metal. In at least one embodiment, the roller shaft 186 may be composed of a corrosive resistant metal, such as a CRS. In still other embodiments, the roller shaft 186 may be comprised of a hard plastic. As may be appreciated, any suitable material may be used.

The cavity 189 of the main bracket connection 188 may be threaded and configured to align with the roller shaft aperture 159, such that a screw, or other fastening means, may be inserted through the roller shaft aperture 159 and into the cavity 189, thereby securing the roller shaft 186 to the main bracket 152. In various embodiments, the roller shaft 186 and mounting roller 180 may be configured, generally, in the same plane as the one or more rollers of the dispensing system 112, such that the film 114 may pass over the mounting roller 180 without disrupting the flow of the film 114 as it is dispensed by the dispensing system 112. For example, as seen in FIGS. 1, 4, and 5, the film 114 may be configured to pass over roller 117 and roller 118 of the dispensing system 112 before passing over the mounting roller 180. The film 114 may further be configured to continue on through the dispensing system 112, eventually passing over the one or more remaining rollers of the dispensing system 112. In some embodiments, the mounting roller 180 may be configured such that it is, generally, the same height as roller 117 of the dispensing system 112. In other embodiments, the mounting roller 180 may not be the same height as any roller of the dispensing system 112.

Figure 11C:
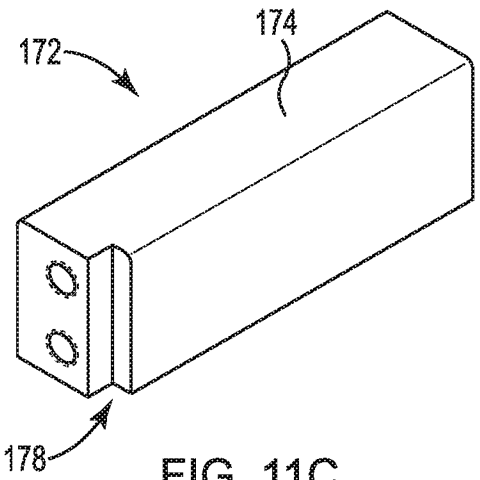
FIG. 11C is a perspective view sketch of a print table, according to an embodiment of the present disclosure.
Figure 11A:
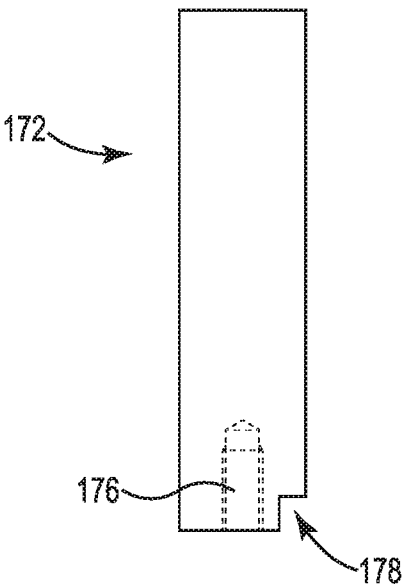
FIG. 11A is a perspective view sketch of a print table, according to an embodiment of the present disclosure.
Figure 11B:
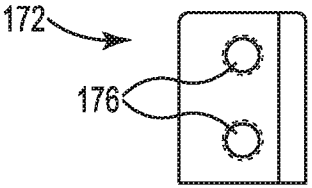
FIG. 11B is a perspective view sketch of a print table, according to an embodiment of the present disclosure.
Figure 12D:
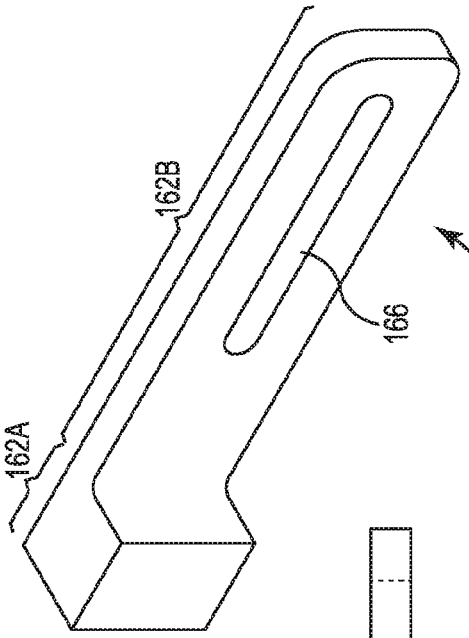
FIG. 12D is a perspective view sketch of a cross mount bracket, according to an embodiment of the present disclosure.
Figure 12C:
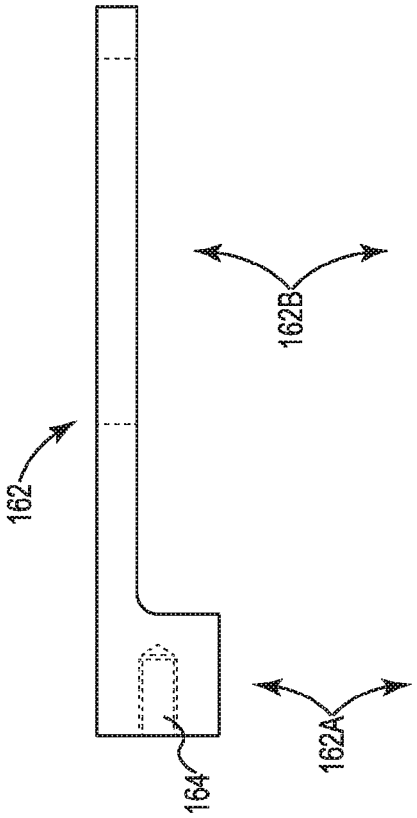
FIG. 12C is a perspective view sketch of a cross mount bracket, according to an embodiment of the present disclosure.
Figure 12B:
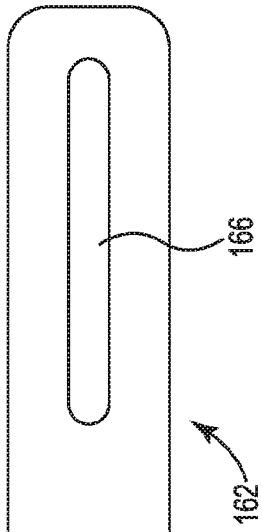
FIG. 12B is a perspective view sketch of a cross mount bracket, according to an embodiment of the present disclosure.
Figure 12A:
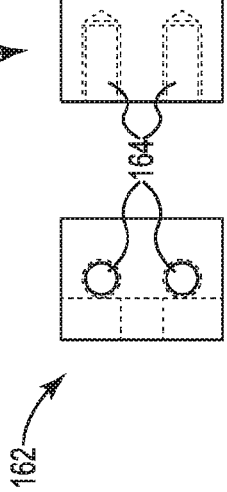
FIG. 12A is a perspective view sketch of a cross mount bracket, according to an embodiment of the present disclosure.
Figure 13B:
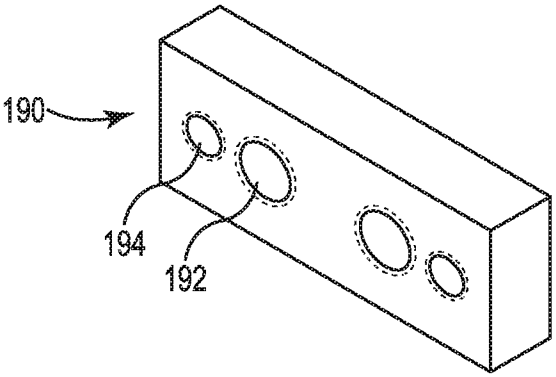
FIG. 13B is a perspective view sketch of an adapter block, according to an embodiment of the present disclosure.
Figure 13D:
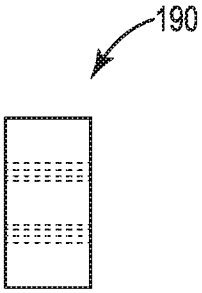
FIG. 13D is a perspective view sketch of an adapter block, according to an embodiment of the present disclosure.
Figure 13A:
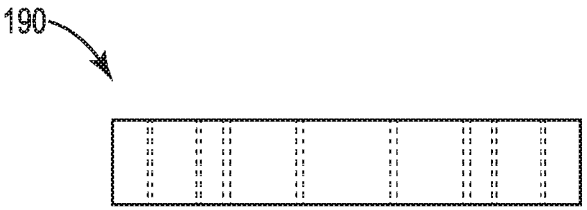
FIG. 13A is a perspective view sketch of an adapter block, according to an embodiment of the present disclosure.
Figure 13C:
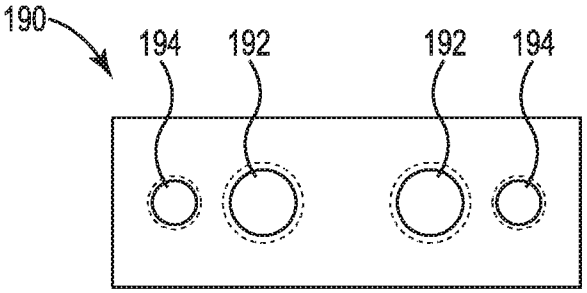
FIG. 13C is a perspective view sketch of an adapter block, according to an embodiment of the present disclosure.

A print table 172 may, additionally or alternatively, be used. In various embodiments, the print table 172, seen in FIGS. 11A-C, may have at least one flat surface 174 over which the film 114 may pass as it is dispensed. In some embodiments, the flat surface 174 may be substantially flat, as shown in FIG. 11C. In other embodiments, the flat surface 174 may have one or more rounded edges. In various embodiments, the print table 172 may be 1-5 inches long or have a length the same as or similar to rollers 117 and 180. In other embodiments, the print table 172 may be shorter than 1 inch or longer than 5 inches. In various embodiments, the flat surface 174 may be 0.5 to 1.5 inches wide. In other embodiments, the flat surface 174 may be less than 0.5 inches wide or greater than 1.5 inches wide.

The print table 172 may be configured to connect to the main bracket 152 and to provide a flat printing surface across which the film 114 may pass for printing. In some embodiments, the print table 172 may have one or more cavities 176, which may be configured to receive a bolt or screw. The bolt, screw, or other suitable device may pass through the print table aperture 160 and into the one or more cavities 176 such that it secures the print table 172 to the main bracket 152. In at least one embodiment, the cavities 176 may be threaded. In some embodiments, one or more cavities 176 may pass through the length of the print table 172. In other embodiments, the one or more cavities 176 may extend less than the entire length of the print table 172. In at least one embodiment, the print table 172 may have one or more nooks, keys, or keyways 178. The nook 178 may connect to, or hug, a part of the main bracket 152, the taping device 110, or some other structure such that it may assist in securing the print table 172 into place and prevent twisting, etc.

In some embodiments, the print table 172 may be positioned between roller 117 of the dispensing system 112 and mounting roller 180. In some embodiments, the print table 172 may be slightly elevated in comparison to roller 117 of the dispensing system 112 and/or the mounting roller 180. The slight elevation may help to ensure the film 114 is flat and/or taught on the flat surface 174, which may assist in printing. In other embodiments, the print table 172 may be substantially similar in elevation to roller 117 and/or mounting roller 180.

The print table 172 may be composed of any suitable material. In at least one embodiment, the print table 172 is composed of aluminum, steel, and/or another metal.

Referring to FIGS. 12A-D, a cross mount bracket 162 may be used to secure the printer 132 to the main bracket 152. The cross mount bracket 162 may have two ends, a main bracket end 162A and an adapter aperture end 162B. On the main bracket end 162A, the cross mount bracket 162 may have one or more cavities 164, which may be configured to receive a bolt or screw. The bolt, screw, or other suitable device may pass through the cross mount aperture 158 and into the one or more cavities 164 such that it secures the cross mount bracket 162 to the main bracket 152. In some embodiments, the cavities 164 may be threaded. In another embodiment, one or more of the cavities 164 may be tubes, thereby allowing a nut and bolt to secure the cross mount bracket 162 to the main bracket 152. On the adapter aperture end 162B, the cross mount bracket 162 may also have an adapter aperture 166, which may be used to connect the printer 132 to the cross mount bracket 162. In at least one embodiment, the main bracket end 162A may be thicker than the adapter aperture end 162B. For example, as seen in FIG. 12, the main bracket end 162B may be 0.75 inches wide whereas the adapter aperture end 162B may only be 0.25 inches wide. In some embodiments, the main bracket end 162A may be thicker or thinner than 0.75 inches wide. In some embodiments, the adapter aperture end 162B may be thicker or thinner than 0.25 inches wide. In still other embodiments, the main bracket end 162A and the adapter aperture end 162B may be the same, or substantially the same, width.

In one embodiment, the cross mount bracket 162 may be 4.5 inches long. In some embodiments, the cross mount bracket 162 may be 3-6 inches long. In still other embodiments, the cross mount bracket may be shorter than 3 inches or longer than 6 inches long. In some embodiments, the cross mount bracket 162 may be 0.5 inches in height. In other embodiments, the cross mount bracket 162 may be shorter or taller than 0.5 inches. In various embodiments, the cross mount bracket 162 may be made from aluminum. In other embodiments, the cross mount bracket 162 may be made from any suitable material.

In some embodiments, and with reference to FIGS. 13A-D, an adapter block 190 may be used, in addition to the cross mount bracket 162, to secure the printer 132 to the main bracket 152. As seen in FIG. 7, the adapter block 190 may be positioned between the cross mount bracket 162 and the printer 132. The adapter block 190 may have one or more cavities 192, 194, which may be configured to receive a bolt, screw, or other securing device. In one embodiment, one or more of the cavities 192, 194 may extend the entire width of adapter block 190. In other embodiments, one or more of the cavities 192, 194 may extend less than the entire width of adapter block 190. In at least one embodiment, cavities 192 and cavities 194 may extend from opposite sides into adapter block 190. In some embodiments, cavities 192 may be configured to secure the cross mount bracket 162 to the adapter block 190 whereas cavities 194 may be configured to secure the adapter block 190 to the printer 132.

In some embodiments, the adapter block 190 may be 0.5 inches in height. In other embodiments, the adapter block 190 may be less than or greater than 0.5 inches in height. In some embodiments, the adapter block 190 may be approx. 1.5 inches long. In other embodiments, the adapter block 190 may be less than or greater than 1.5 inches long. In some embodiments, the adapter block 190 may be 0.25 inches wide. In other embodiments, the adapter block 190 may be less than or greater than 0.25 inches wide. In various embodiments, the adapter block 190 may be made of aluminum. In other embodiments, the adapter block 190 may be made from any other suitable material.

In various embodiments, the cross mount bracket 162, and perhaps the adapter block 190, may position the printer 132 such that the printer head or ink dispenser is situated directly above the flat surface 174 of the print table 172.

The following discussion is directed to a method of making and a method of use for the adhesive film printing apparatus. It is to be appreciated that the steps of using an adhesive film printing apparatus can be implemented using any number of different embodiments.

In some embodiments, the adhesive film printing apparatus may be used in an assembly line. In other embodiments, the adhesive film printing apparatus may be stand alone, whereby each package is manually loaded into the machine, for example. In still other embodiments, the adhesive film printing apparatus may print onto the adhesive side of the film and re-roll the film for storage or resale.

Figure 15:
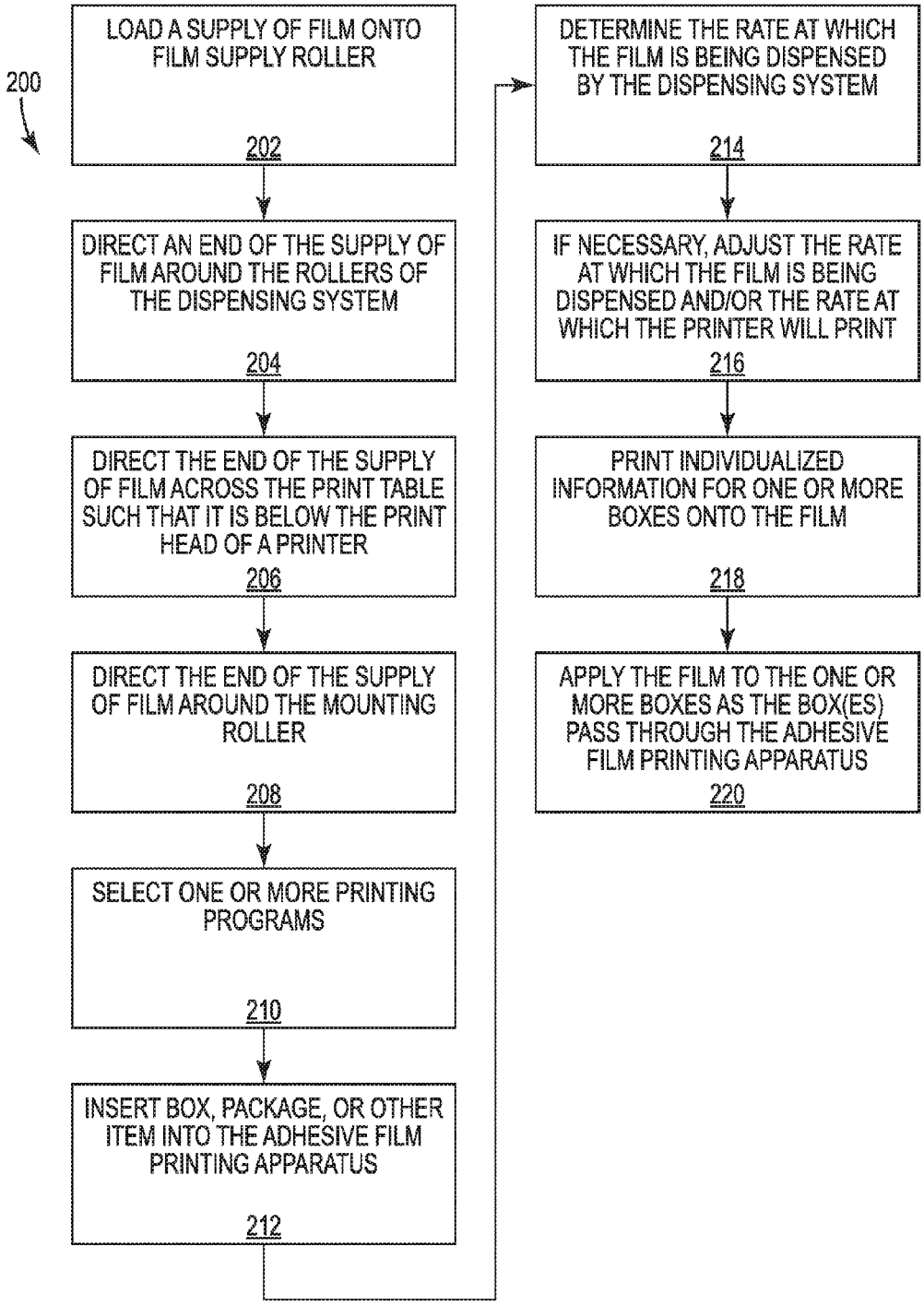
FIG. 15 is a flow chart for a method of use, according to an embodiment of the present disclosure.

Referencing FIG. 15, a method of use 200 is presented. The user may load a supply of film onto the film supply roller, see Block 202. In various embodiments, the film may be substantially unmarked. In some embodiments, one or more markings may already be printed onto the film. The film of the adhesive film printing apparatus may be held, dispensed, and applied to packages or other objects in a manner substantially similar to conventional taping machines. That is, the user may load the film into the machine and around the one or more rollers of the dispensing system, see Block 204. While loading the film 114, the user may additionally pass the film over the flat surface of the print table, see Block 206. The user may then wrap the film around the mounting roller, see Block 208, before continuing to load the film over the remaining one or more rollers of the dispensing system. In a preferred embodiment, the adhesive side of the film will be facing up as it is loaded over the flat surface of the print table and as such passes below the print head positioned directly above it. It is to be appreciated that, in the case of a box taper or other package, a similar approach may be used for the top, bottom, and/or sides.

Once the film is loaded into the tape printing apparatus, the user may select one or more printing programs, see Block 210. A user may pre-select or pre-load one or more programs. In some embodiments, a user may then designate one or more programs to be used for a given period of time, e.g., the day. In another embodiment, a user may designate one or more programs to be used for a given number of boxes, packages, or items, e.g., the next 100 boxes, packages, or items. In still other embodiments, one or more sensors or computers along the assembly line may, additionally or alternatively, communicate with the printing control system and activate one or more programs. The one or more designated or activated programs may communicate with the printer such that the printer prints the desired information onto the adhesive side of the film as it passes over the flat surface of the print table, see Block 218. In one or more embodiments, and before the information is printed onto the film, a deter ruination of the rate at which the film is being dispensed by the dispensing system may be made, see Block 214. If the dispensing rate is different than the rate at which the printer may print, the rate of the film being dispensed may be decreased or increased, see Block 216. In at least one embodiment, the rate of printing may, additionally or alternatively, be adjusted, see Block 216. The printed film may continue on through the dispensing system such that as one or more boxes, packages, or other items are inserted into the adhesive film printing apparatus, see Block 212, the film will be applied as the box, package, or other item passes through the adhesive film printing apparatus, see Block 220. In at least one other embodiment, the printed film may continue on through the dispensing system and be re-rolled for storage or resale.

For purposes of this disclosure, any system described herein may include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, a system or any portion thereof may be a personal computer (e.g., desktop or laptop), tablet computer, mobile device (e.g., personal digital assistant (PDA) or smart phone), server (e.g., blade server or rack server), a network storage device, or any other suitable device or combination of devices and may vary in size, shape, performance, functionality, and price. A system may include random access memory (RAM), one or more processing resources such as a central processing unit (CPU) or hardware or software control logic, ROM, and/or other types of nonvolatile memory. Additional components of a system may include one or more disk drives or one or more mass storage devices, one or more network ports for communicating with external devices as well as various input and output (I/O) devices, such as a keyboard, a mouse, touchscreen and/or a video display. Mass storage devices may include, but are not limited to, a hard disk drive, floppy disk drive, CD-ROM drive, smart drive, flash drive, or other types of non-volatile data storage, a plurality of storage devices, or any combination of storage devices. A system may include what is referred to as a user interface, which may generally include a display, mouse or other cursor control device, keyboard, button, touchpad, touch screen, microphone, camera, video recorder, speaker, LED, light, joystick, switch, buzzer, bell, and/or other user input/output device for communicating with one or more users or for entering information into the system. Output devices may include any type of device for presenting information to a user, including but not limited to, a computer monitor, flat-screen display, or other visual display, a printer, and/or speakers or any other device for providing information in audio form, such as a telephone, a plurality of output devices, or any combination of output devices. A system may also include one or more buses operable to transmit communications between the various hardware components.

One or more programs or applications, such as a web browser, and/or other applications may be stored in one or more of the system data storage devices. Programs or applications may be loaded in part or in whole into a main memory or processor during execution by the processor. One or more processors may execute applications or programs to run systems or methods of the present disclosure, or portions thereof, stored as executable programs or program code in the memory, or received from the Internet or other network. Any commercial or freeware web browser or other application capable of retrieving content from a network and displaying pages or screens may be used. In some embodiments, a customized application may be used to access, display, and update information.

Hardware and software components of the present disclosure, as discussed herein, may be integral portions of a single computer or server or may be connected parts of a computer network. The hardware and software components may be located within a single location or, in other embodiments, portions of the hardware and software components may be divided among a plurality of locations and connected directly or through a global computer information network, such as the Internet.

As will be appreciated by one of skill in the art, the various embodiments of the present disclosure may be embodied as a method (including, for example, a computer-implemented process, a business process, and/or any other process), apparatus (including, for example, a system, machine, device, computer program product, and/or the like), or a combination of the foregoing. Accordingly, embodiments of the present disclosure may take the form of an entirely hardware embodiment, an entirely software embodiment (including firmware, middleware, microcode, hardware description languages, etc.), or an embodiment combining software and hardware aspects. Furthermore, embodiments of the present disclosure may take the form of a computer program product on a computer-readable medium or computer-readable storage medium, having computer-executable program code embodied in the medium, that define processes or methods described herein. A processor or processors may perform the necessary tasks defined by the computer-executable program code. Computer-executable program code for carrying out operations of embodiments of the present disclosure may be written in an object oriented, scripted or unscripted programming language such as Java, Perl, PHP, Visual Basic, Smalltalk, C++, or the like. However, the computer program code for carrying out operations of embodiments of the present disclosure may also be written in conventional procedural programming languages, such as the C programming language or similar programming languages. A code segment may represent a procedure, a function, a subprogram, a program, a routine, a subroutine, a module, an object, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

In the context of this document, a computer readable medium may be any medium that can contain, store, communicate, or transport the program for use by or in connection with the systems disclosed herein. The computer-executable program code may be transmitted using any appropriate medium, including but not limited to the Internet, optical fiber cable, radio frequency (RF) signals or other wireless signals, or other mediums. The computer readable medium may be, for example but is not limited to, an electronic, magnetic, optical, electromagnetic, infrared, or semiconductor system, apparatus, or device. More specific examples of suitable computer readable medium include, but are not limited to, an electrical connection having one or more wires or a tangible storage medium such as a portable computer diskette, a hard disk, a random access memory (RAM), a read-only memory (ROM), an erasable programmable read-only memory (EPROM or Flash memory), a compact disc read-only memory (CD-ROM), or other optical or magnetic storage device. Computer-readable media includes, but is not to be confused with, computer-readable storage medium, which is intended to cover all physical, non-transitory, or similar embodiments of computer-readable media.

Various embodiments of the present disclosure may be described herein with reference to flowchart illustrations and/or block diagrams of methods, apparatus (systems), and computer program products. It is understood that each block of the flowchart illustrations and/or block diagrams, and/or combinations of blocks in the flowchart illustrations and/or block diagrams, can be implemented by computer-executable program code portions. These computer-executable program code portions may be provided to a processor of a general purpose computer, special purpose computer, or other programmable data processing apparatus to produce a particular machine, such that the code portions, which execute via the processor of the computer or other programmable data processing apparatus, create mechanisms for implementing the functions/acts specified in the flowchart and/or block diagram block or blocks. Alternatively, computer program implemented steps or acts may be combined with operator or human implemented steps or acts in order to carry out an embodiment of the invention.

Additionally, although a flowchart may illustrate a method as a sequential process, many of the operations in the flowcharts illustrated herein can be performed in parallel or concurrently. In addition, the order of the method steps illustrated in a flowchart may be rearranged for some embodiments. Similarly, a method illustrated in a flow chart could have additional steps not included therein or fewer steps than those shown. A method step may correspond to a method, a function, a procedure, a subroutine, a subprogram, etc.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an ingredient or element may still actually contain such item as long as there is generally no measurable effect thereof.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

We claim:

1. A printing apparatus, comprising:

a box taper comprising:

a package platform configured to support a box;

a frame supporting the package platform; and a tape dispensing device configured and arranged to dispense and apply tape to the box when the box is passed across the package platform, the tape having an adhesive side; and a print device comprising a print head and arranged with respect to the dispensing device in a position and orientation such that the tape dispensed from the dispensing device passes adjacent the print head with the adhesive side of the tape exposed to the print head, wherein the print device is configured to impart variable information on the adhesive side of the tape.

2. The printing apparatus of claim 1, further comprising a mounting assembly comprising a bracket for supporting the print device relative to the dispensing device, and a printing table for supporting the tape during a printing process.

3. The printing apparatus of claim 2, wherein the mounting assembly further comprises a mounting roller for routing the tape dispensed from the dispensing device to the print table for printing.

4. The printing apparatus of claim 3, wherein the print table and mounting roller arrange the tape with the adhesive side facing the print device.

5. The printing apparatus of claim 2, wherein the bracket is a first bracket, and the mounting assembly further comprises a second bracket coupled to the first bracket.

6. The printing apparatus of claim 5, wherein the second bracket is coupled to the first bracket at an angle of about 90 degrees.

7. The printing apparatus of claim 5, wherein the mounting assembly further comprises a roller shaft coupling a mounting roller to the first bracket.

8. The printing apparatus of claim 1, wherein the dispensing device comprises a plurality of rollers.

9. A printing process, comprising:

receiving a box to be taped and passing the box across a package platform of a box taper, the package platform supported by a frame;

dispensing a film using a dispensing system, the film having an adhesive side;

imparting information on the adhesive side of the film with a print device comprising a print head, by passing the film adjacent the print head with the adhesive side of the film exposed to the print head, the print device coupled to the dispensing system and configured to impart variable information; and applying the film to the box as the box passes across the package platform.

10. The printing process of claim 9, wherein passing the film adjacent the print head with the adhesive side of the film exposed to the print head comprises passing the film over a print table arranged adjacent the print device.

11. The printing process of claim 10, further comprising directing the film to the print table with a mounting roller.

12. The printing process of claim 9, wherein the print device is coupled to the dispensing system by a mounting assembly comprising a bracket.

13. The printing process of claim 12, wherein the bracket is a first bracket, and the mounting assembly further comprises a second bracket coupled to the first bracket.

14. The printing process of claim 9, wherein the dispensing system comprises a plurality of rollers.

15. The printing process of claim 9, further comprising monitoring the dispensing rate of the film and imparting information on the film at a rate consistent with the dispensing rate.

16. The printing process of claim 9, wherein the box is a first box, and the information imparted is first information, the process further comprising:

receiving a second box to be taped and passing the second box across the package platform of the box taper;

imparting second information on the adhesive side of the film with the print device; and applying the film to the second box as the second box passes across the package platform.

17. A box taping apparatus comprising:

a dispensing device dispensing tape for application on a box, the tape having an adhesive side;

a package platform supported by a frame, the package platform configured and arranged to support the box while tape from the dispensing device is applied to the box; and a print device comprising a print head and arranged with respect to the dispensing device in a position and orientation such that the tape dispensed from the dispensing device passes adjacent the print head with the adhesive side of the tape exposed to the print head, wherein the print device is configured to impart variable information on the adhesive side of the tape.

18. The box taping apparatus of claim 17, further comprising a mounting assembly comprising a bracket for supporting the print device relative to the box taper, and a print table for supporting the tape during a printing process.

19. The box taping apparatus of claim 18, wherein the mounting assembly further comprises a mounting roller for routing the tape dispensed from the dispensing device to the print table for printing.

20. The box taping apparatus of claim 17, wherein the dispensing device comprises a plurality of rollers.

* * * * *